US007263807B2

(12) United States Patent
Gumpert

(10) Patent No.: US 7,263,807 B2
(45) **Date of Patent: *Sep. 4, 2007**

(54) SMOKE VENT LIGHT TRANSMITTING ROOFING PANEL

(75) Inventor: John Larry Gumpert, Pointblank, TX (US)

(73) Assignee: LTP Technologies, Inc., Pointblank, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/383,404

(22) Filed: May 15, 2006

(65) Prior Publication Data

US 2006/0191230 A1 Aug. 31, 2006

Related U.S. Application Data

(63) Continuation-in-part of application No. 10/919,885, filed on Aug. 17, 2004, now Pat. No. 7,043,882, which is a continuation of application No. 09/860,156, filed on May 17, 2001, now Pat. No. 6,775,951, which is a continuation of application No. 09/493,381, filed on Jan. 28, 2000, now abandoned.

(51) Int. Cl.
*E04B 7/18* (2006.01)

(52) U.S. Cl. ..... 52/200; 52/202; 52/309.3; 52/588.1; 52/DIG. 17

(58) Field of Classification Search ..... 52/200, 52/309.5, 309.3, 202, 201, 107, 45, 204.5, 52/506.01, 788.1, 802.1, DIG. 16, DIG. 17, 52/171.1, 536, 537, 203, 28, 38–40; 40/578, 40/561; 362/147
See application file for complete search history.

(56) References Cited

U.S. PATENT DOCUMENTS 2,615,512 A * 10/1952 Friis ..... 160/27
2,790,400 A 4/1957 Wasserman
3,918,226 A * 11/1975 Naidus ..... 52/232
4,009,548 A 3/1977 Hicks
4,117,638 A 10/1978 Kidd, Jr. et al.
4,449,344 A 5/1984 Dodich
4,473,979 A 10/1984 Bruhm
4,509,791 A * 4/1985 Bienert et al. ..... 296/216.09
4,549,379 A 10/1985 Hoy et al.
4,649,680 A 3/1987 Weisner et al.
4,658,559 A * 4/1987 Doherty ..... 52/463
4,730,426 A 3/1988 Weisner et al.
4,805,363 A * 2/1989 Gold ..... 52/208
4,825,608 A 5/1989 Makin
4,848,051 A 7/1989 Weisner et al.
4,860,511 A 8/1989 Weisner et al.
4,930,274 A * 6/1990 Cummings et al. ..... 52/200
4,968,088 A * 11/1990 Schurmann ..... 296/216.02
4,986,039 A * 1/1991 Weisner ..... 52/72
5,323,576 A 6/1994 Gumpert et al.
6,775,951 B2 * 8/2004 Gumpert et al. ..... 52/200
7,043,882 B2 5/2006 Gumpert et al.

OTHER PUBLICATIONS

U.S. Appl. No. 09/493,381, Gumpert et al.
Plasteco, Inc., When it Comes to Standard Skylights, We've Got you Covered, brochure, Houston, TX, 2004, 4 pgs.

(Continued)

*Primary Examiner*—Carl D. Friedman
*Assistant Examiner*—Chi Q. Nguyen
(74) *Attorney, Agent, or Firm*—Akin Gump Strauss Hauer & Feld LLP; Dwayne L. Mason

(57) ABSTRACT

A light transmitting panel capable of acting as a smoke vent and of the type for connecting within a metal roofing system is provided. The light transmitting panel includes a translucent panel that melts away rapidly under high temperature, a metal panel and a linear coefficient buffer therebetween to allow the respective panels to expand and contract with respect to the other without loss of containment or seal.

30 Claims, 7 Drawing Sheets

OTHER PUBLICATIONS

NJ State Safety Council, Laborer Dies After Falling 30 Feet Through a Fire-vent Skylight, http://www.cdc.gov/niosh/fact/statefact/nj/96nj003.html, Jun. 27, 1996, 4 pgs.

Ruchala, Kurt, P.E., Small Atria Smoke Control, Reprinted with permission from Fire Protection Engineering Magazine. Copyright Society of Fire Protection Engineers, 4 pgs.

The Williams Bros. Corp. of America, Smoke Vents-Double Lid, 2 pgs., http://www.wbdoors.com/doublelid.htm?sicontent, 2005.

The Williams Bros. Corp. of America, Product Guide Specification, 11 pgs. (no date).

* cited by examiner

SMOKE VENT LIGHT TRANSMITTING ROOFING PANEL

CROSS-REFERENCE TO RELATED APPLICATIONS

This application is a continuation-in-part of U.S. application Ser. No. 10/919,885 filed Aug. 17, 2004, now U.S. Pat. No. 7,043,882, which is a continuation of U.S. application Ser. No. 09/860,156, filed May 17, 2001, now U.S. Pat. No. 6,775,951, which is a continuation-in-part of U.S. application Ser. No. 09/493,381, filed Jan. 28, 2000, now abandoned, each of these applications are hereby incorporated by reference herein, in their entirety.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to smoke venting system for roofs, and more particularly, to a light transmitting panel that operates as a smoke vent within a metal roofing system.

2. Description of the Related Art

For many years commercial buildings have utilized sheet metal roofs. Recently it has become more common and popular to utilize sheet metal roofs on residential homes, shops, patios and the like. Typically, the standing seam metal roof utilizes metal sheets having lateral upturned edges. The panels are laid side by side with the lateral edges of one panel contiguous with the upstanding edge of adjacent panels. The panels are joined together by a cap piece or by folding over the upstanding edge to tightly hold the panels together. The roofs are sloped so that water runs down the trough formed between the upstanding edges of each panel.

The above referenced roofing systems may take many forms such as, but not limited to, trapezoidal, 90-degree modular, architectural, and industrial. Metal roofs may have minor ribs, stiffener ribs, or no ribs of all and may be a screw down roofing system. All of these roofing systems are similar in the requirement of attaching the panels at adjacent edges or side rails.

It is very often desirable with metal roofing systems to have additional natural lighting whereby sunlight is permitted to enter the structure through the roof. Heretofore, this natural lighting was provided by installing domed skylights of either the curb or curbless variety. Unfortunately, skylights can be expensive and create water leakage. One of the causes of water leakage is due to the restricted flow path of water between the domed skylight and the standing seam, whereby the water level rises such as to penetrate the roof at the panel junctions. Additional problems arise with domed skylights when freezing temperatures are encountered. Ice and/or snow may collect between the skylight and the dome, and as the ice melts it is blocked by ice dams resulting in the level of water rising and penetrating the panel seam.

Curbed skylights include a "curb" which is a raised structure formed around the opening in the roof upon which the transparent material is attached. The curb raises the seal between the curb and the transparent material above the point of water flowing down the roof. However, curbs are expensive to construct and to install. If not installed correctly leaks will develop around the curb and roof junction resulting in expensive repair. Additionally, installing curbed skylights requires cutting a hole in the existing roof which is performed at the job site increasing the cost of the skylight.

Curbless skylights have been utilized and by definition do not require a raised frame. However, the prior art skylights typically utilize flashing, mechanical fasteners, and or sealing rings to install and to alleviate water leakage. Although curbed skylights do provide benefits over curbless skylights, curbed skylights often increase the weight of the panel with framing, increase the likelihood of water leakage and increase the cost of the metal roofing.

In addition, OSHA requires that skylights be less than twelve inches in width or length, or a metal grate is required to be placed over the skylight. In order to meet these requirements the skylights and light transmitting panels in the prior art required a combination of fasteners, clips, clips, and fasteners, flanges, etc. in order to secure the transparent or semi-transparent material to the sheet metal surfaces. The differences in the respective linear coefficients of expansion of the various materials of construction resulted in systems that would inherently fail over time. The failures resulted from movement of the various materials in various directions due to the heating and cooling affect that occurs every day. With materials often moving in opposite directions fatigue occurs causing cracks, leaks and the inability to meet OSHA and UL testing requirements as discussed below.

During the heating and cooling cycle of a typical day, the metal roof and its components expand and contract. For example, it is not an unusual occurrence in a normal pitched roof to expand and contract as much as 6" over a 100 linear feet. As a result of this and other effects, UL 90 requires that a panel withstand a 90 mph wind created uplift without loss of containment. In order to achieve this, again the prior art systems employed very elaborate clip and/or conventional fasteners. However, due to the vastly different linear expansion coefficients of the fasteners, metal panels, clips, and metal panels and light transmitting panels, loss of containment or component failure would occur as noted above over time.

It would be a benefit therefor, to have a light transmitting panel adapted for connection in a metal roofing system that did not comprise the use of clips, fasteners and the like to secure the light transmitting panel to the metal panel while at the same time meeting ASTM 252 bag test and UL 90 requirements. It would be a further benefit to have a light transmitting panel which has side rails adapted for connecting with metal roofing panels. It would be a still further benefit to have a light transmitting panel prefabricated for installation on site in a metal roofing system in the same manner as standard metal roofing panels. It would be a still further benefit to have a light transmitting panel having substantially the same strength characteristics as adjacent metal panels. It would be a further benefit to allow for smoke venting of a light transmitting panel.

BRIEF SUMMARY OF THE INVENTION

It is thus an object of this invention to provide a light transmitting panel for use in metal roofing systems for allowing ambient light to enter a structure and which meets UL 90 and ASTM 252 bag test specifications without the use of conventional fasteners or clips.

It is a further object of this invention to provide a light transmitting panel which is inexpensive and may be constructed off site.

It is a still further object of this invention to provide a light transmitting panel which is readily connectable in a metal roofing system in the same manner as standard metal roofing panels.

It is yet a further object of this invention to provide a light transmitting panel that will vent smoke.

Accordingly, a light transmitting panel of the type for connecting within a metal roofing system is provided. The light transmitting panel includes a translucent panel, a metal panel and a linear coefficient buffer therebetween.

The linear coefficient buffer is adapted to connect the translucent panel and the metal panel in such a was as to allow the translucent panel and metal panel to expand and contract according to its individual linear coefficient relative to the other without loosing containment.

The linear coefficient buffer may comprise any material which allows the light transmitting panel to expand and contract along the metal panel and vice versa, without loss of containment or seal therebetween. In a preferred embodiment, the linear coefficient buffer comprises and may be selected from the group consisting of adhesives, adhesive gaskets, adhesive foam and adhesive rubber. In a most preferred embodiment the linear coefficient buffer is a SIKA 252 adhesive, manufactured by SIKA Industries. In order to allow for the expansion and contraction of the materials the linear coefficient buffer thickness will be generally in the range of about 0.1 mil.-20 mil., and more specifically in the range of 2 mil.-10 mil. in thickness. While we have disclosed that certain adhesives, gaskets, and other materials may comprise the buffer, one skilled in the art will understand that any material capable of adhering to the translucent panel and the metal panel so as to allow the respective panels to move according to their respective linear coefficients without resulting in a loss of containment so that if they can do that, then they fall within the scope of the linear coefficient buffers according to the present invention.

The light transmitting panel may further comprise a pair of side rails on both the metal panel and light transmitting panel. The side rails may form a 90° angle, a trapezoid shape or any other shape. In this embodiment, the light transmitting panel side rails are disposed adjacent to the metal panel side rails in the metal roofing system.

The light transmitting panel may comprise material such as, but not limited to, fiberglass, polycarbonates, and acrylic so as to allow ambient or exterior light to enter a structure through the light transmitting panel. It is not required for the translucent material to be transparent. The translucent section may be planar, substantially planar, or have a domed section formed therein. The translucent section has a planar section running approximate the lateral or longitudinal sides which may turn into an angled portion extending from the planar portion. The angle of departure between the angled portion and the planar portion is chosen so as to match the configuration of the side rail of the particular metal roofing system in which it is to be installed.

The side rails are chosen to match the roofing system in which the light transmitting panel is to be installed. The side rails may be obtained from cutting the middle section out of an existing metal panel. The side rails may be individually turned to match particular roofing systems. Typically the side rails will have at least one horizontal portion and an angled portion extending therefrom. The adhesion surface of the horizontal portion, and the angled portion if desired, should be cleaned to remove foreign material, protective coatings and metal oxides before the adhesive is applied to join the side rails with the translucent material.

Once the translucent material is formed to match the side rails chosen for the installation a chemical adhesive or bonding material is applied to either or both the translucent material and the adhesion surface of the side rails. A neutral cure 100 percent silicon adhesive or a urethane compound adhesive is desired because of its ability to bond many combinations of material without a chemical degradation and its strength. The side rails and translucent material are then compressed at the contact point and the adhesive is allowed to cure. Once the adhesive has cured the light transmitting panel will have substantially the same configuration and strength characteristics of the metal roofing panels for a particular installation. In particular, the light transmitting panel will have properties which allow it to be installed in a metal roofing system in a manner so as not to require metal grating to be installed in conjunction. The light transmitting panel may then be shipped to the site to be installed and will not require any additional equipment or additional expertise of the on-site personnel for installation. The smoke vent will typically use a grating to protect the panel surface.

Once on site the light transmitting panel may be installed in the same manner as the metal roofing panels utilized in the construction. The adjacent side rails may be connected by rolling, folding, or caps and additionally may include screws or other types of mechanical fasteners. Light transmitting panels may be installed adjacent to other light transmitting panels and/or metal roofing panels.

The light transmitting panels used as smoke vents are preferably comprised of a melt out plastic or other material to allow for automatic removal at high temperature to allow for automatic porting of smoke in the event of fire.

The foregoing has outlined the features and technical advantages of the present invention in order that the detailed description of the invention that follows may be better understood. Additional features and advantages of the invention will be described hereinafter which form the subject of the claims of the invention.

DETAILED DESCRIPTION OF THE INVENTION

Figure 1:
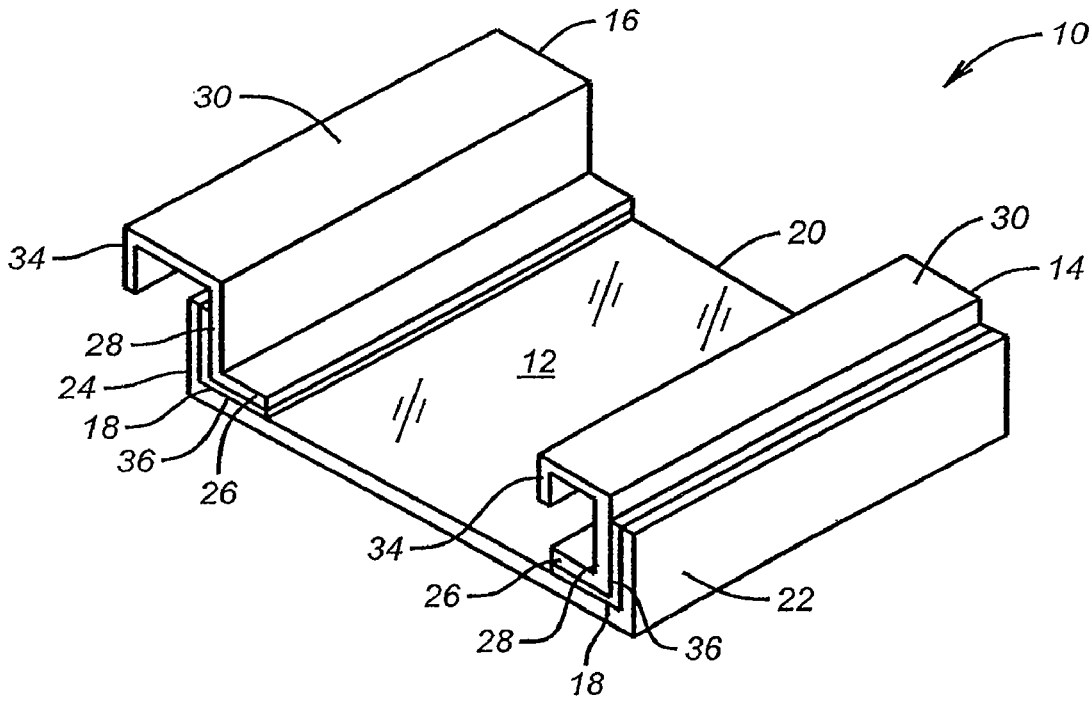
FIG. 1 is a perspective view of a light transmitting panel of the present invention.

Refer now to the drawings wherein depicted elements are not necessarily shown to scale and wherein like or similar elements are designated by the same reference numeral through the several views.

FIG. 1 is a perspective view of a light transmitting panel of the present invention, generally designated by the numeral 10. Light transmitting panel 10 includes a translucent section 12, first side rail 14, second side rail 16, and a chemical adhesive 18.

Translucent section 12 in the embodiment shown is constructed of fiberglass and permits the passage of light exterior of the structure, such as sun light, to be transmitted into a structure on which it is installed. Translucent section 12 may be constructed of thermoset or thermoformed material such as, but not limited to, fiberglass, polycarbonates, and acrylic either singularly or in combination. Translucent section 12 is constructed of material so as to substantially match the characteristics of the metal panels utilized in the roofing system. It is desired that translucent section 12 have strength characteristics which alleviate requirements of metal grating. As shown, and in the present embodiment, light transmitting panel 12 is constructed so as to withstand at least 200 pounds per square foot of pressure so as not to require metal grating pursuant to OSHA regulations.

Translucent section 12 includes a planar section 20, and may have a first and second lateral, angled portion 22, 24. As shown in FIG. 1, when present, lateral portions 22, 24 are angled approximately perpendicular to planar section 20 to form a 90-degree modular system. Translucent section 12 may be formed to fit and match any metal roofing design configuration.

Side or locking rails 14, 16 are constructed of metal of the same type as the roofing system in which the present invention is to be installed. Side rails 14, 16 are formed by taking a metal panel section of the design type chosen for a roof and cutting the side rails from the metal panel. As shown in FIG. 1, side rails 14 and 16 are adapted for incorporation in metal roofing systems in which the roofing panels have male and female side rails 14, 16 which are interconnected by rolling or folding, and possibly caps or mechanical fasteners. However, the present invention is adaptable to many shapes, and forms of side rails 14, 16, three examples of which are shown in FIGS. 1 through 4.

Figure 5:
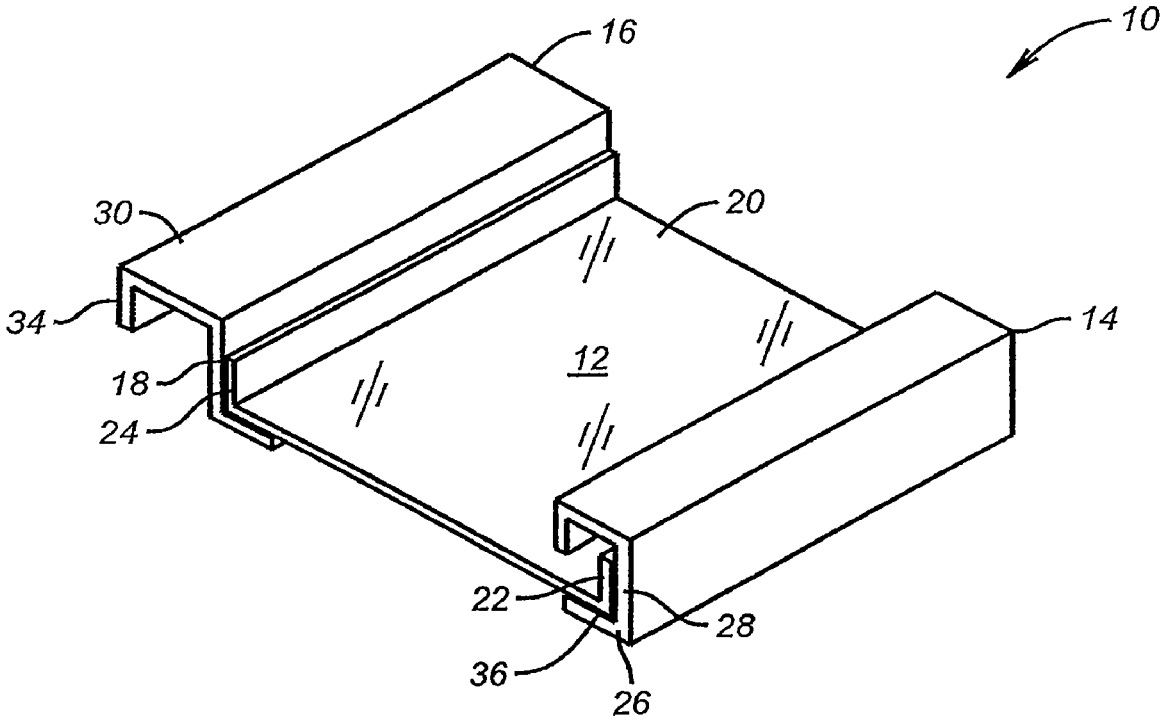
FIG. 5 is a perspective view of another embodiment of a light transmitting panel of the present invention.
Figure 6:
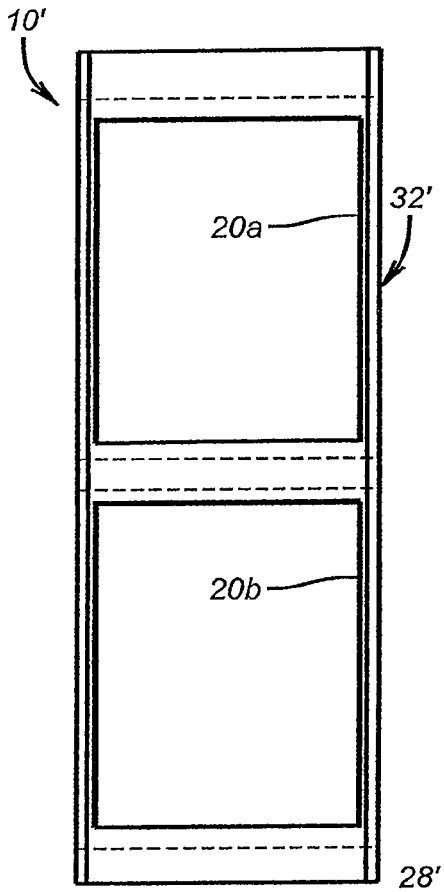
FIG. 6 is a plan view of another embodiment of the light transmitting panel.

As shown in FIG. 1, first side rail 14 is a female side rail having a first horizontal portion 26 and a first angled portion 28 which extends substantially perpendicular and upward from first horizontal portion 26. Second side rail 16 is a male side rail also having a first portion 26 and first angled portion 28 which extends substantially perpendicular and upward from first horizontal portion 26. Both side rails 14 and 16 have a top locking section 30. In the female side rails, top locking section 30 of side rail 14 extends in the same direction as first horizontal portion 26 and is substantially parallel to first portion 26. In the male side rails, top locking section 30 of side rail 16 extends in the opposite direction as first portion 26 and is substantially parallel to first portion 26. As shown in FIG. 1, side rails 14 and 16 are adapted for connecting to adjacent light transmitting panels 10 or adjacent metal roofing panels 32 (FIG. 2) by rolling or folding and therefor include tongues 34. One or both tongues 14 may be deleted still allowing a rolled connection via locking section 30. Additionally, at least first horizontal portion 26 and possibly first angled portion 28 have an adhesion surface 36 for connecting translucent section 12 such that section 12 is located below side rails 14 and 16. However, as shown in FIGS. 5 and 6, translucent section 12 may be adhered atop side rails 14 and 16.

Side rails 14 and 16 are connected to translucent section 12 by an adhesive or bonding agent to form light transmitting panel 10. Examples of adhesives or bonding agents are UNI-WELD, a two-part epoxy from Kent Industries, and adhesives from Dynatron Bondo Adhesives. In particular, it is desired to utilize a neutral 100 percent silicone adhesive.

To connect side rails 14 and 16 to translucent section 12 adhesion surface 36 and the surface of a portion of first planar section 20 adjacent to lateral angled portion 22 and lateral angled portion 22 should be cleaned to remove any foreign materials, protective coatings such as terne, and metal oxides. An adhesive or bonding agent 18 is applied to adhesion surface 36 and/or translucent section 12 and side rails 14 and 16 are placed in position whereby horizontal portions 26 are disposed upon a portion of planar section 20 and first angled portion 28 is disposed upon first lateral portion 22 of translucent section 12. Side rails 14 and 16 and translucent section 12 are compressed together and adhesive 18 is allowed to cure to form light transmitting panel 10.

Figure 2:
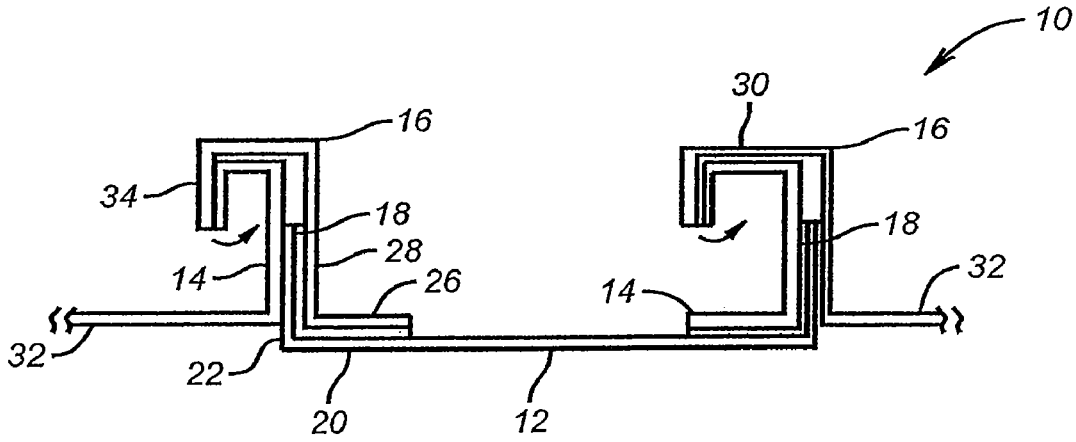
FIG. 2 is a front, planar view of the light transmitting panel of the present invention in connection with adjacent panels.

FIG. 2 is a front, planar view of light transmitting panel 10 of the present invention in connection with adjacent metal roofing panels 32. As shown, adjacent side rails 14 and 16 are positioned so that a male side rail 16 overlaps a female side rail 14. To connect panels 10 and panels 32 or panels 10 to adjacent panels 10 (not shown) by folding tongues 34 in the direction of the arrows. It should be recognized that tongue 34 is not necessary.

Figure 3:
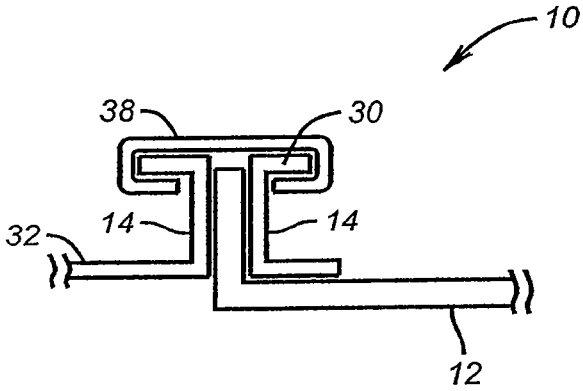
FIG. 3 is a front, planar view of an alternative connection of the light transmitting panel of the present invention and an adjacent panel.

FIG. 3 is a front, planar view of an alternative connection of light transmitting panel 10 of the present invention and an adjacent metal roofing panel 32. FIG. 3 demonstrates the connection of adjacent roofing panels 10 and 32 utilizing a cap 38. Metal roofing panel 32 utilizes a female side rail 14 as does light transmitting panel 10. Each panel 32 and 10 are placed side by side in a manner such that side rails 14 are adjacent and top locking sections 30 extend away from each other. A cap 38 is slid onto both side rails 14 along top locking sections 30 or cap 38 is placed atop locking sections 30 and crimped thereon. Although not shown this connection may be made between adjacent light transmitting panels 10 in the same manner. Note that the embodiment shown in FIG. 3, the lateral, angled portion 22 of the translucent section 12 is optional.

Figure 4:
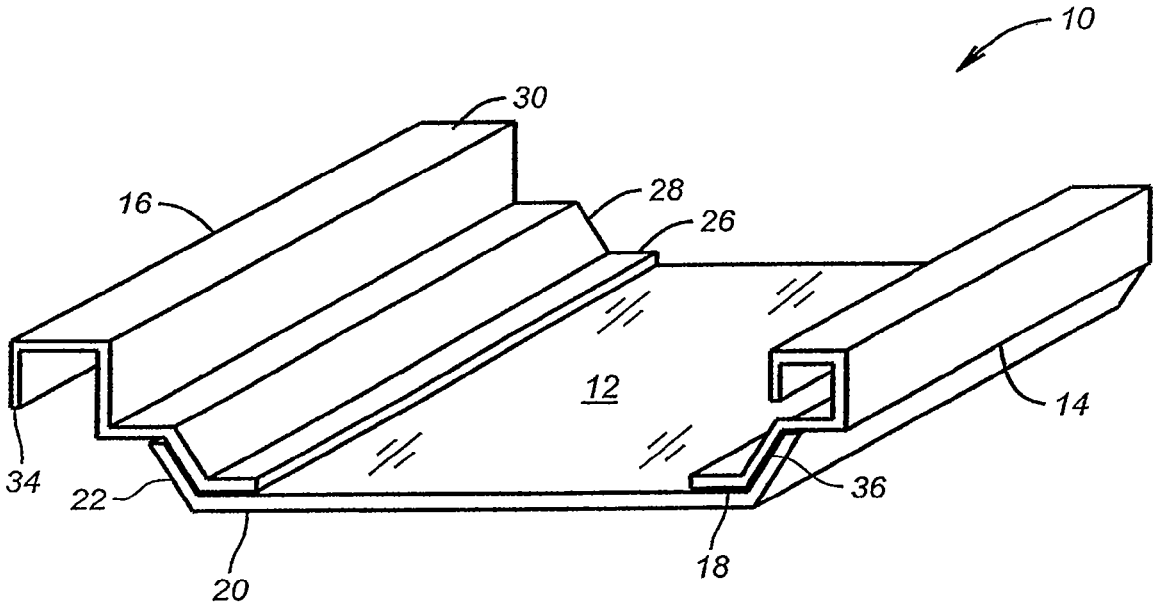
FIG. 4 is a perspective view of another configuration of the light transmitting panel of the present invention.

FIG. 4 is a perspective view of another configuration of light transmitting panel 10 of the present invention shown in a trapezoidal configuration. In the trapezoidal configuration translucent section 12 has a first angled portion 22 which extends upwardly from planar portion 20 at an angle to match the angle that first angled portion 28 of side rails 14 and 16 extends from first horizontal portion 26 of side rails 14 and 16. In this embodiment translucent material 12 is connected to side rails 14 and 16 in the same manner as described above. Additionally, light transmitting panel 10 as shown in FIG. 4 may be connected to adjacent light transmitting panels 10 and/or metal roofing panels as shown in FIG. 2.

FIG. 5 is a perspective view of another embodiment of light transmitting panel 10 of the present invention. Light transmitting panel 10 includes a translucent section 12, first side rail 14, second side rail 16, and a chemical adhesive 18.

Translucent section 12 in the embodiment shown is constructed of a translucent or transparent material, such as fiberglass, and permits the passage of light exterior of the structure, such as sun light, to be transmitted into a structure on which it is installed. Translucent section 12 may be constructed of thermoset or thermoformed material such as, but not limited to, fiberglass, polycarbonates, and acrylic either singularly or in combination. Translucent section 12 is constructed of material so as to substantially match the characteristics of the metal panels utilized in the roofing system. It is desired that translucent section 12 have strength characteristics which alleviate requirements of metal grating, unless the embodiment is for a smoke vent light transmitting panel 50 as described herein.

Translucent section 12 includes a planar section 20, and may have a first and second lateral, angled portion 22, 24. As shown in FIG. 1, when present, lateral portions 22, 24 are angled approximately perpendicular to planar section 20 to form a 90-degree modular system. Translucent section 12 may be formed to fit and match any metal roofing design configuration.

Side or locking rails 14, 16 are constructed of metal of the same type as the roofing system in which the present invention is to be installed. Side rails 14, 16 are formed by taking a metal panel section of the design type chosen for a roof and cutting the side rails from the metal panel.

Although not shown, it is contemplated to connect a cap or seal atop or about translucent section 12 so as to aid in the prevention of water entry through the connection between section 12 and side rails 14, 16.

Use of light transmitting panel 10 is now described with reference to FIGS. 1 through 5. A metal roofing panel (not shown) is taken and the panel is cut so as to provide two side rails 14 and 16. Side rails 14 and 16 may be of any configuration so as to match the roofing system in which light transmitting panel 10 is to be installed. Additionally, side rails 14 and 16 may be turned individually to match the side rails of the roofing installation in which to be installed. A translucent section 12 formed of thermoset or thermoformed material such as, but not limited to, fiberglass, polycarbonates, and acrylic is formed so as to have a planar section 20 and may have an adjacent lateral angled section 22. Translucent section 12 is formed so that lateral angled portions 22 are angled from planar section 20 to match the angle between first horizontal section 26 and first angled portion 28 of side rails 14, 16. Adhesion surface 36 of side rails 14, 16 should be cleaned as well as the contacting surface of translucent material 12. An adhesive or bonding agent 18 is applied to adhesion surface 36 and/or translucent section 12. Side rails 14 and 16 are placed in contact with translucent material 12 such that horizontal portions 26 and planar sections 20 and angled portions 28 and lateral angled portions 22 are aligned. Compression is applied to side rails 14, 16 and translucent section 12 and adhesive 18 is allowed to cure. Once adhesive 12 is cured light transmitting panel 10 is completed and may be shipped for installation in a metal roof system. Light transmitting panel 10 may be installed in any system in which side rails 14, 16 are adapted, whether it be by rolling, folding, caps, and/or mechanical fasteners for connection with adjacent metal roofing panels.

Figure 8:
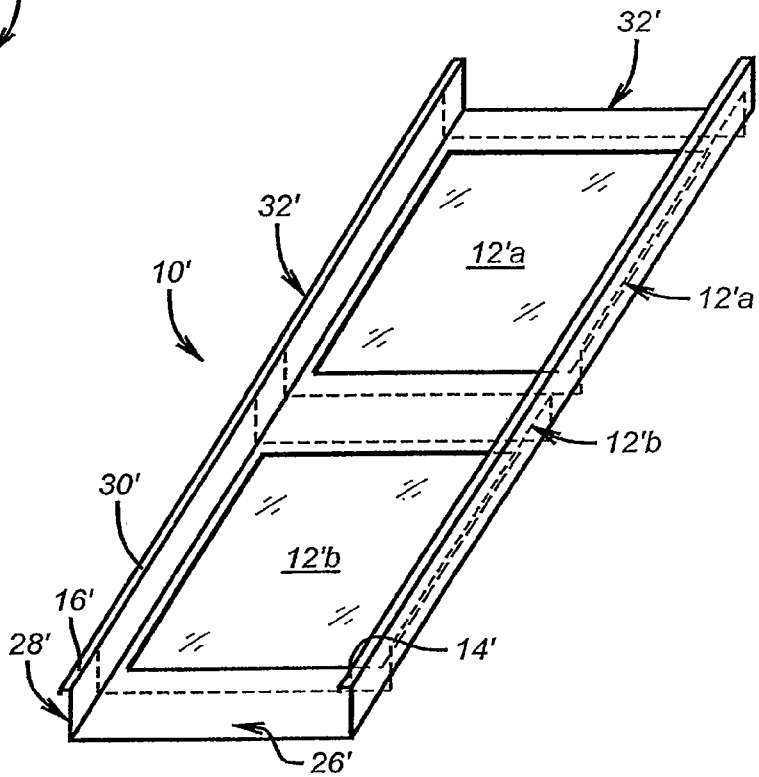
FIG. 8 is a perspective view of the embodiment of the light transmitting panel of FIG. 6.
Figure 7:
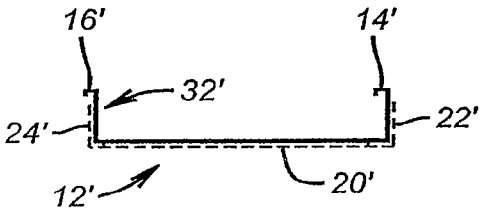
FIG. 7 is a front, planar view of the embodiment of the light transmitting panel of FIG. 6.

With reference to FIGS. 6-9, further embodiments of the present invention are disclosed. The embodiment of FIGS. 6-8 shows a bonded light transmitting panel 10' comprising translucent panels 12'*a* and 12'*b*, a roofing panel 32'. The utilization of a standard roofing panel 32' in this embodiment provides compatibility with other roofing panels 32' and/or light transmitting panels 10'.

With reference to FIG. 6, a plan view of the bonded light transmitting panel 10' is shown. In this embodiment, the roofing panel 32' has a portion cut-out, allowing exposure of the planar sections 20'*a* and 20'*b*, corresponding to translucent panels 12'*a* and 12'*b* (FIG. 8). Thus, the light can be transmitted through translucent panels 12'*a* and 12'*b* (FIG. 8) while the exterior portions of roofing panel 32'—as described below—allow connection with other roofing panels and/or light transmitting panels.

With reference to FIG. 7, a front, planar view of the bonded light transmitting panel 10' is shown. Translucent panels 12 (indicated 12'*a* and 12'*b* in FIG. 8) includes a planar section 20' (indicated 20'*a* and 20'*b* in FIG. 6), and may have a first and second lateral, angled portion 22', 24'. In this embodiment, when present, lateral portions 22', 24' are angled approximately perpendicular to planar section 20' to form a 90-degree modular system. While these lateral portions 22', 24' are shown in this embodiment, other embodiments may not have them. In the embodiment shown in FIG. 7, lateral portions 22', 24' extend upward toward side rails 14', 16'. By this illustration, it should become apparent to one of ordinary skilled in the art that translucent panels 12 (indicated 12'*a* and 12'*b* in FIG. 8) may be formed to fit and match any roofing design configuration.

With reference to FIG. 8, a perspective view of the bonded light transmitting panel 10' is shown. The two translucent panels 12'*a* and 12'*b* in this embodiment permit the passage of light exterior of the structure, such as sun light, to be transmitted into a structure on which it is installed. The translucent panels 12'*a* and 12'*b* may be constructed of thermoset material such as, but not limited to fiberglass, polycarbonates, and acrylic either singularly or a combination of polycarbonates. Furthermore, the translucent panels 12'*a* and 12'*b* can be constructed so as to substantially match the characteristics of the roofing panels utilized in the roofing system.

In the embodiment shown in FIG. 8, side rails 14' and 16' of roofing panel 32'—as briefly described above—are adapted for incorporation in roofing systems in which the roofing panels have male and female side rails 14', 16' which are generally interconnected by rolling or folding, or by utilizing caps or mechanical fasteners. As an illustrative example, roofing panel 32' can be a standard roofing panel, adapted to connect with other standard roofing panels, which is removed and cut out in the manner describe with reference to FIG. 6. In other embodiments, the light transmitting panels 10' can be adaptable to many shapes and forms of side rails 14, 16 (both from standard roofing panels and those adapted for connection with the metal roofs, in general).

With reference once again to FIG. 8, first side rail 14' is a female side rail and second side rail 16' is a male side rail. Both side rails 14' and 16' have a top locking section 30'. As shown in FIG. 8, side rails 14' and 16' are adapted for connecting to adjacent light transmitting panels 10' or adjacent roofing panels 32'. At least horizontal portion 26' and possibly first angled portion 28' are coupled to the roofing panels 32'.

Figure 9A:
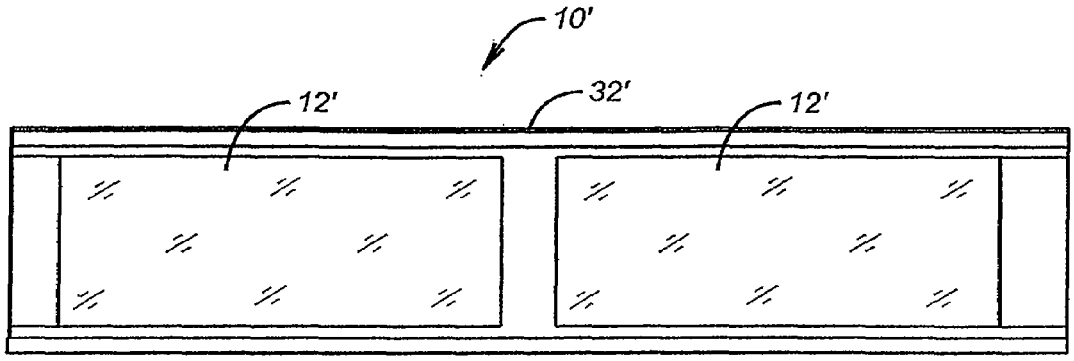
FIG. 9A is a plan view of another embodiment of the light transmitting panel.
Figure 9B:
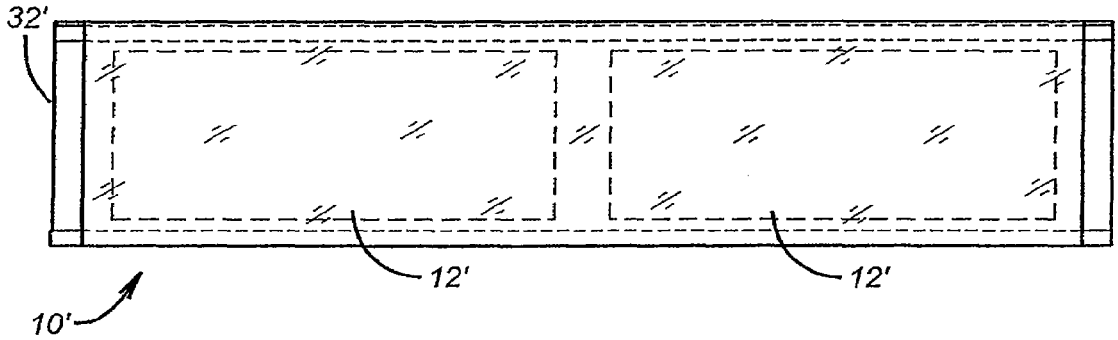
FIG. 9B is a layered view of the embodiment of the light transmitting panel of FIG. 9A.
Figure 9C:
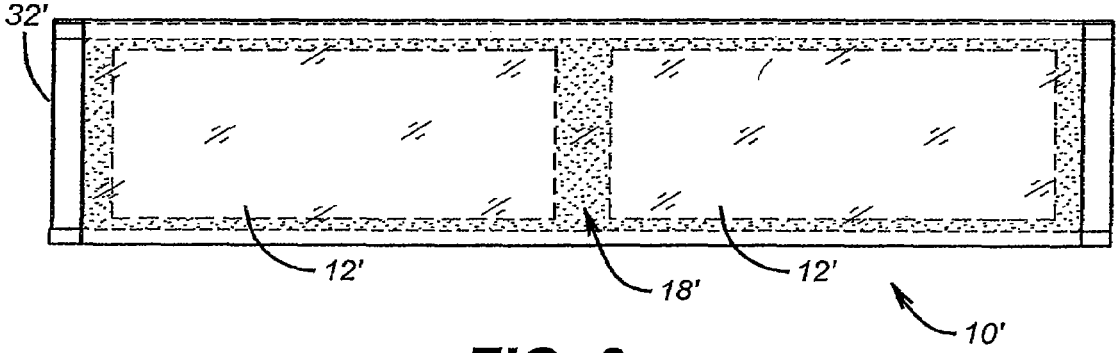
FIG. 9C is another layered view of the embodiment of the light transmitting panel of FIG. 9A.

With reference to FIGS. 9A-9C, another embodiment of the invention is shown with a translucent section 12' coupled to a roofing panel 32'. FIGS. 9A-9C are similar to the embodiment of FIGS. 6-8 in that a standard roofing panel 32' can be utilized with a portion thereof cut-out, exposing the translucent section 12'. FIG. 9A shows a top plan view of a single translucent section 12' being divided by a portion of the roofing panel 32' into two separate light transmitting areas. As will be appreciated by those in the art, such a configuration can be used in some embodiments to facilitate structural integrity (e.g., desired force per surface area support) of each light transmitting area of the translucent section 12'.

FIG. 9B is a layered view showing the translucent section 12' with the roofing panel 32' shown in partial phantom view. FIG. 9C is another layered view showing an illustrative example of an area for the location of the linear coefficient buffer 18', generally referenced in other embodiments. It will become apparent to one of ordinary skill in the art that such an area can change depending on the desired structural dynamics of light transmitting panel 10' and linear coefficient buffer 18' utilized.

Figure 9D:
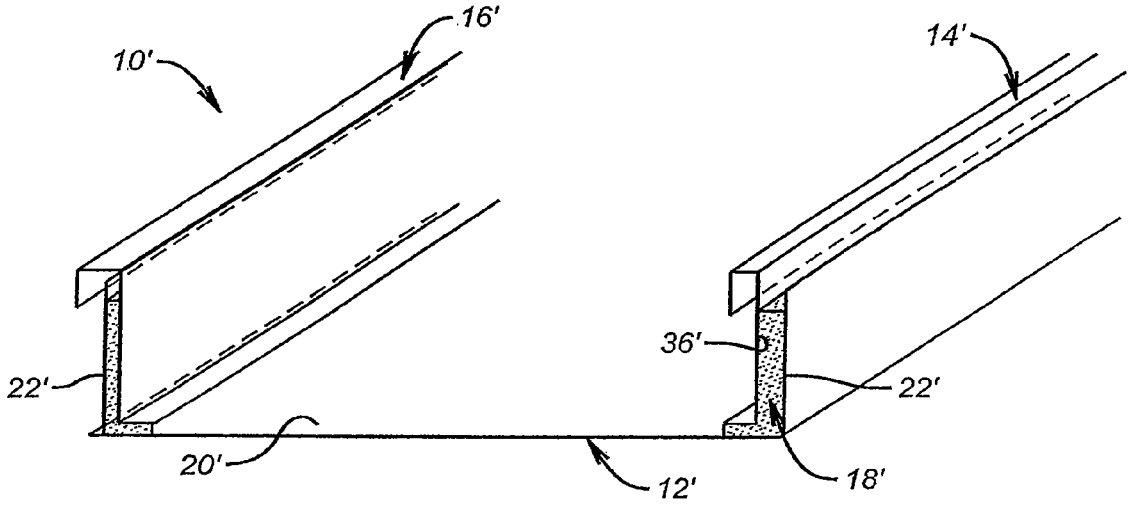
FIGS. 9D and 9E are illustrative embodiments of the light transmitting panel.
Figure 9E:
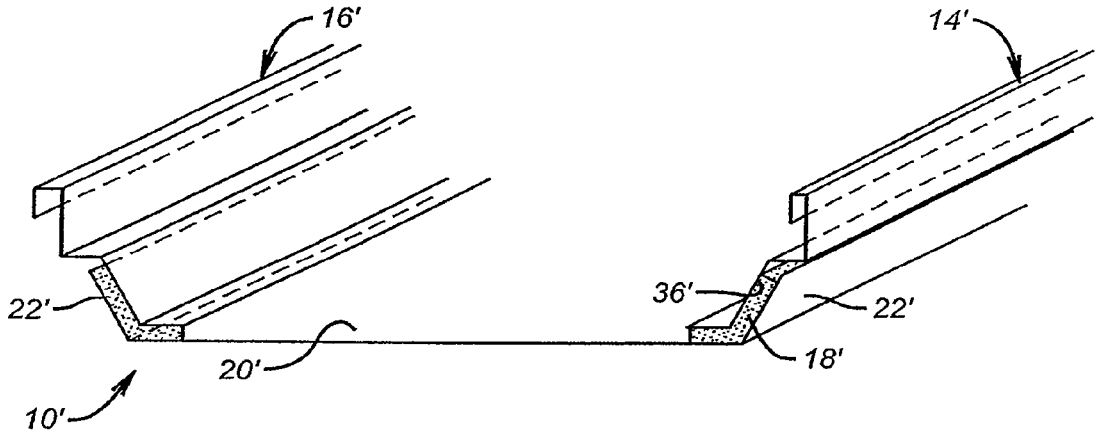

With reference to FIGS. 9D-9E, an illustrative embodiment shows how the side rails 14' and 16' can be connected to translucent section 12' by a linear coefficient buffer 18', thereby absorbing the expansion and contraction between the roofing panel 32' and the translucent section 12'. Additionally, this illustrative embodiment shows how the linear coefficient buffer 18' may also serve as an adhesive or bonding agent to form the bonded light transmitting panel 10'. Examples of adhesives or bonding agents are UNI-WELD, a two-part epoxy from Kent Industries, adhesives from Dynatron Bondo Adhesives, and adhesives by SIKA or Michigan Adhesive Mfg. Inc. In addition, it may be desirable to utilize a neutral cure, or urethane, silicone adhesive on the edges of the translucent section 12' as a secondary seal.

To connect side rails 14' and 16' to translucent section 12' adhesion surface 36 and the surface of a portion of first planar section 20' adjacent to lateral angled portion 22' and lateral angled portion 22' should be cleaned according to procedures known in the art to remove any foreign materials, protective coatings such as terne, and metal oxides. The linear coefficient buffer 18' is applied to adhesion surface 36' so that translucent section 12' may be disposed upon a portion of planar section 20' and first angled portion 28'. Side rails 14' and 16' and translucent section 12' are compressed together and adhesive 18' is allowed to cure to form light transmitting panel 10'.

As can be seen with reference to embodiments of FIGS. 9A-9E, the translucent section 12' of the light transmitting panel 10' can be connected to side rails 14' and 16' or directly to the roofing panel 32'. In addition, as discussed above, the side rails 14' and 16' may be adapted individually to match the side rails of the roofing installation in which they are to be installed. Therefore, the translucent section 12' can be formed to fit and match any metal roofing design configuration.

Although the present invention and its advantages have been described in detail, it should be understood that various changes, substitutions and alterations can be made herein without departing from the spirit and scope of the invention as defined by the appended claims. For example, many configurations of metal roofing panels exist to which the light transmitting panel of the present invention may be adapted, many translucent materials are available for use in the light transmitting panel, and additionally it is contemplated that mechanical fasteners such as screws and nuts and bolts may be used for additional security between adjacent metal roofing panels and light transmitting panels, and adhesion of the light transmitting panels along a single portion or section of the side rails.

The invention will be further described by the following example. This example is not intended to be limiting, in any way, the invention being defined by the appended claims.

EXAMPLE

A light transmitting panel assembly according to the present invention was constructed for testing under UL 90 test requirements. A five (5) panel assembly was created wherein one of the panels included a light transmitting panel. The panels were nominally ten feet (10') in length and two feet (2') wide. The panel which comprised the light transmitting panel assembly included a metal panel including one cut-out nominally 17"×53" and two cut-outs that nominally 17"×24". A translucent fiberglass panel nominally 8 oz./ft$^2$ (~0.045" thick) was overlaid onto the metal panel so as to cover the cut-outs. A SIKA 252 adhesive was used as the linear coefficient buffer and was disposed between the metal panel and translucent fiberglass panel to a thickness of 2.5 mil. A neutral cure silicone (Silpruf manufactured by Bayer Corporation) was used as an addition adhesive/buffer on the light transmitting panel edges as a secondary seal and to prevent the infusion of air or water under the panel in the event of a void in the SIKA adhesive. The five (5) panel assembly including the light transmitting panel assembly was testing according to ASTM specification UL 90. After the testing, the light transmitting panel assembly was inspected and no break down or fatigue of the component parts was observed.

Figure 10A:
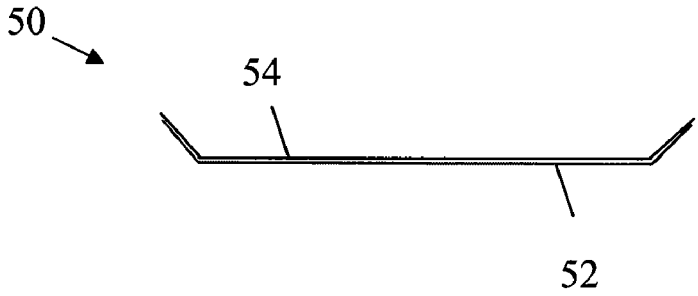
FIGS. 10A and 10B are an end and a top view of a light transmitting panel of the present invention in the trapezoidal configuration that is also a smoke vent embodiment.
Figure 10B:
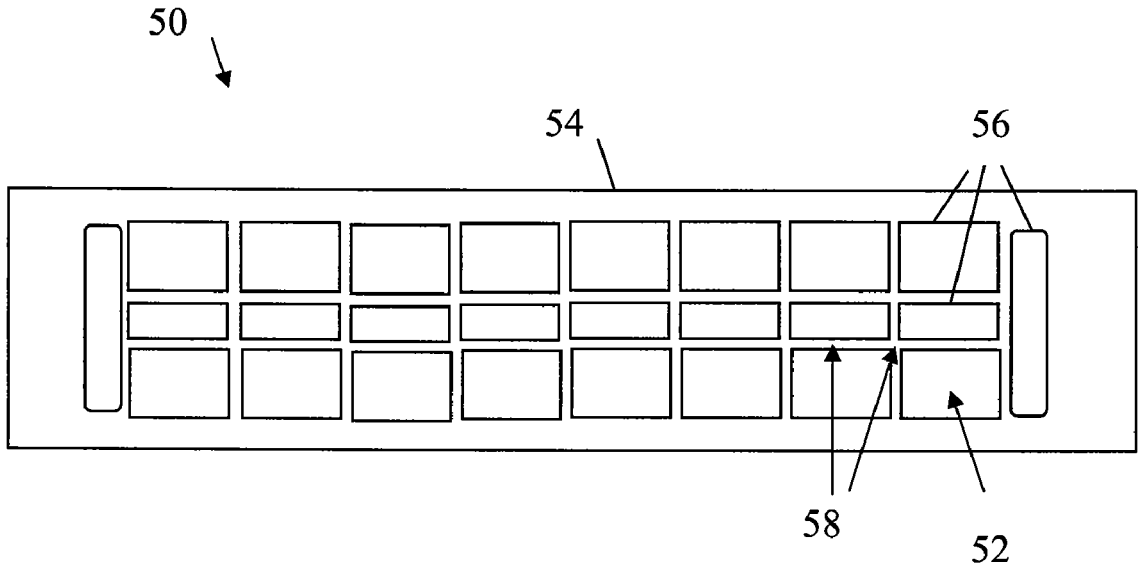

Turning to FIGS. 10A and 10B, an end view and a top (or bottom) view, respectively, of a smoke vent embodiment of the light transmitting panel of the present invention are illustrated. A smoke vent panel 50 of the present invention for use in a metal roof system includes a metal panel 54 cut into any design. The metal panel 54 in FIGS. 10A and 10B is in the trapezoidal configuration similar to the light transmitting panel shown in FIG. 4. The smoke vent panel 50 also includes a translucent material 52 substantially in the same shape as the metal panel 54 placed below the metal panel 54. The translucent material 52 is sealed to the metal panel 54 with an appropriate linear coefficient buffer as described herein. In various embodiments, the translucent material 52 includes a planar section 20" and may include first and second lateral angled portions 22" and 24".

The composition of the translucent material 52 is preferably a plastic, which may be a laminate, such as used in melt-away domed skylights. Most of these materials are proprietary to the manufacturer, but are will known in the art. In various embodiments, the translucent material 52 is a meltable and/or shrinkable acrylic. In some embodiments, the translucent material 52 has a melting point of less than 200 degrees Fahrenheit. Note that in a smoke vent 50 embodiment of the present invention, structural support for weight by the translucent material 52 need not rise to the level of the structural support supplied by translucent material 12 in other embodiments of the light transmitting panels of the present invention. In the embodiment of FIGS. 10A and 10B, the openings 56 are cut with a plasma cutting machine. Other manufacturing methods are contemplated. Note also that the translucent material 52 may be transparent or translucent.

In the top view shown in FIG. 10B, a pattern may be seen in the metal panel 54 such that safety cross-over material 58 is present between openings 56 to protect from fall-through. The geometry of the pattern may of different designs in different embodiments. In one embodiment, the area of any one opening 56 is less than twelve square inches. In another embodiment, the cross-over material 58 is capable of supporting up to 200 pounds per square foot.

While the smoke vent panel 50 has been illustrated with respect to the trapezoidal configuration, other configurations are contemplated. Other contemplated configurations include architectural standing seam with or without minor ribs, architectural standing seam with or without geometric differences in the openings 56 to allow for the use of a protective grate, exposed fastener roof panels with or without minor ribs, exposed fastener roof panels with or without geometric differences in the openings 56 to allow for the use of a protective grate, including the well-known "R" panel and "U" panel. In particular, the smoke vent panel 50 may be configured in various embodiments compatible with the embodiments of the light transmitting panels 10, 10' shown in FIGS. 1-3, FIG. 5, FIGS. 6-9*d*, and FIG. 9*e*. Other configurations are contemplated based on aesthetic and/or safety considerations.

In the presence of flame or high temperature, according to the material used for the translucent material 52, the translucent material 52 will melt and fall out to allow for automatic venting of smoke that may be present. The safety cross-over material 58 is configured to allow for workers or firemen to cross the smoke vent panel 50 without falling through to the floor below. In a preferred embodiment, the safety cross-over material 58 provides fall protection that meets OSHA Regulation § 1926.501 "Duty to have Fall Protection." In some embodiments, the safety cross-over material 58 provides fall protection that meets local or state regulations. In some cases, a grate may become necessary.

The foregoing disclosure and description of the preferred embodiments are illustrative and explanatory thereof, and various changes in the components, elements, configurations, and connections, as well as in the details of the illustrated construction and method of operation may be made without departing from the spirit and scope of the invention.

I claim:

1. A light transmitting panel for use as a smoke vent in a metal roof system, said light transmitting panel comprising:

a translucent section of a material that falls away rapidly during an exposure to a high temperature or a flame;

a metal panel with the translucent section, wherein the metal panel has a plurality of lipless openings spaced such that the metal panel is capable of bearing weight; and a linear coefficient buffer disposed between the translucent section and the metal panel.

2. The light transmitting panel of claim 1, wherein:

the linear coefficient buffer is selected from the group consisting of adhesives, adhesive gaskets, adhesive rubber, and adhesive foam.

3. The light transmitting panel of claim 2, wherein:

the linear coefficient buffer is a chemical adhesive.

4. The light transmitting panel of claim 2, wherein:

the linear coefficient buffer is an adhesive gasket.

5. The light transmitting panel of claim 2, wherein:

the linear coefficient buffer is in the range of 0.5 mil-20 mil. in thickness.

6. The light transmitting panel of claim 2, wherein:

the linear coefficient buffer is in the range of 2 mil-10 mil. in thickness.

7. The light transmitting panel of claim 1, wherein:

the material is selected from the group consisting of a thermoset plastic, a thermoformed plastic, a thermoset plastic laminate, a thermoformed plastic laminate, a meltable acrylic, and a shrinkable acrylic.

8. The light transmitting panel of claim 1, wherein:

a shape of the metal panel is selected from the group consisting of architectural standing seam with minor ribs, architectural standing seam without minor ribs, architectural standing seam with geometric differences, architectural standing seam without geometric differences, exposed fastener roof panels with minor ribs, exposed fastener roof panels without minor ribs, exposed fastener roof panels with geometric differences, exposed fastener roof panels without geometric differences, "R" panel, and "U" panel.

9. The light transmitting panel of claim 1, wherein:

each of the plurality of lipless openings is less than twelve (12) inches in either length or width.

10. The light transmitting panel of claim 1, wherein:

the material includes a lateral planar portion and an angled portion extending from the lateral planar portion, and the metal panel includes a lateral planar portion, corresponding to at least a portion of the lateral planar portion of the material, and the metal panel includes an angled portion extending from the lateral planar portion, corresponding to the angled portion of the material.

11. The light transmitting panel of claim 1, wherein:

the light transmitting panel will withstand at least 200 pounds per square foot of pressure.

12. The light transmitting panel of claim 1, wherein:

the material is selected from the group consisting of a thermoset plastic, a thermoformed plastic, a thermoset plastic laminate, a thermoformed plastic laminate, a meltable acrylic, and a shrinkable acrylic.

13. The light transmitting panel of claim 1, wherein:

the material has a melting point of less than 200 degrees Fahrenheit.

14. The light transmitting panel of claim 1, wherein:

the translucent section is transparent.

15. A light transmitting panel for use as a smoke vent in a metal roof system, the light transmitting panel comprising:

a translucent section of a material that falls away rapidly during an exposure to a high temperature or a flame;

a structural member having an edge adjacent to the translucent section, and the translucent section horizontally mates with the edge of the structural member, and wherein a light transmitting area of each of the plurality of lipless openings is less than twelve square inches; and a linear coefficient buffer disposed between the translucent section and the structural member.

16. A light transmitting panel for use in a metal roof system, the light transmitting panel comprising:

a translucent section; and a metal panel having at least one lipless opening therein, and having a protrusionless lowermost surface, and wherein a linear coefficient buffer is disposed between the translucent section and the metal panel.

17. The light transmitting panel of claim 16, wherein:

the linear coefficient buffer is selected from the group consisting of adhesives, adhesive gaskets, adhesive rubber, and adhesive foam.

18. The light transmitting panel of claim 17, wherein:

the linear coefficient buffer is a chemical adhesive.

19. The light transmitting panel of claim 17, wherein:

the linear coefficient buffer is an adhesive gasket.

20. The light transmitting panel of claim 17, wherein:

the linear coefficient buffer is in the range of 0.5 ml-20 mil. in thickness.

21. The light transmitting panel of claim 17, wherein:

the linear coefficient buffer is in the range of 2 mil-10 mil. in thickness.

22. The light transmitting panel of claim 16, wherein:

the linear coefficient buffer is in the range of 2 mu-10 mil. in thickness.

23. The light transmitting panel of claim 16, wherein:

the translucent section is comprised of a material that falls away rapidly during an exposure to a high temperature or a flame.

24. The light transmitting panel of claim 16, wherein:

the metal panel is capable of bearing weight.

25. The light transmitting panel of claim 16, wherein:

the at least one lipless opening is less than twelve (12) inches in either length or width.

26. The light transmitting panel of claim 16, wherein:

the translucent section includes a lateral planar portion and an angled portion extending from the lateral planar portion, and the metal panel includes a lateral planar portion corresponding to at least a portion of the lateral planar portion of the translucent section and an angled portion extending from the lateral planar portion corresponding to the angled portion of the translucent section.

27. The light transmitting panel of claim 16, wherein:

the light transmitting panel will withstand at least 200 pounds per square foot of pressure.

28. The light transmitting panel of claim 16, wherein:

the material is selected from the group consisting of a thermoset plastic, a thermoformed plastic, a thermoset plastic laminate, a thermoformed plastic laminate, a meltable acrylic, and a shrinkable acrylic.

29. The light transmitting panel of claim 16, wherein:

the material has a melting point of less than 200 degrees Fahrenheit.

30. The light transmitting panel of claim 16, wherein:

the translucent section is transparent.

* * * * *